US008297288B2

(12) United States Patent
Yang et al.

(10) Patent No.: US 8,297,288 B2
(45) Date of Patent: Oct. 30, 2012

(54) RECONSTITUTED TOBACCO WITH BONDED FLAVORANT, SMOKING ARTICLE AND METHODS

(75) Inventors: Szu-Sung Yang, Midlothian, VA (US); Trevor Scott Gentry, Midlothian, VA (US); Robley Eugene Pitts, Jr., Midlothian, VA (US); Ricky L. Bowman, Richmond, VA (US)

(73) Assignee: Philip Morris USA Inc., Richmond, VA (US)

( * ) Notice: Subject to any disclaimer, the term of this patent is extended or adjusted under 35 U.S.C. 154(b) by 11 days.

(21) Appl. No.: 12/973,254

(22) Filed: Dec. 20, 2010

(65) Prior Publication Data

US 2011/0083682 A1 Apr. 14, 2011

Related U.S. Application Data

(62) Division of application No. 11/581,492, filed on Oct. 17, 2006, now Pat. No. 7,856,988.

(60) Provisional application No. 60/727,458, filed on Oct. 18, 2005, provisional application No. 60/727,460, filed on Oct. 18, 2005.

(51) Int. Cl.
*A24B 15/00* (2006.01)

(52) U.S. Cl. ..... 131/352; 131/353; 131/275

(58) Field of Classification Search ..... None
See application file for complete search history.

(56) References Cited

U.S. PATENT DOCUMENTS

| | | | |
|---|---|---|---|
| 3,006,347 | A | 10/1961 | Keaton |
| 3,111,127 | A | 11/1963 | Jarboe |
| 3,126,012 | A | 3/1964 | Jarboe et al. |
| 3,128,772 | A | 4/1964 | Jarboe et al. |
| 3,139,888 | A | 7/1964 | Grossman et al. |
| 3,166,078 | A | 1/1965 | Parmele et al. |
| 3,236,244 | A | 2/1966 | Irby, Jr. et al. |
| 3,344,796 | A | 10/1967 | Yamaji et al. |
| 3,426,011 | A | 2/1969 | Parmerter et al. |
| 3,861,402 | A | 1/1975 | Briskin |
| 3,972,335 | A | 8/1976 | Tiggelbeck et al. |
| 4,715,390 | A | 12/1987 | Nichols et al. |

(Continued)

FOREIGN PATENT DOCUMENTS

| | | |
|---|---|---|
| EP | 0345477 | 12/1989 |

(Continued)

OTHER PUBLICATIONS

Merritt, HB, "Table of Possible Additives to Proposed Reconstituted Tobacco" 1978, Philip Morris accessed Feb. 28, 2012 http://legacy.library.ucsf.edu/tid/mcy54e00.*

(Continued)

*Primary Examiner* — Michael J Felton
(74) *Attorney, Agent, or Firm* — Buchanan Ingersoll & Rooney PC

(57) ABSTRACT

A process of manufacturing a reconstituted tobacco material is provided which includes: preparing a heated mixture of water and sugar; providing a liquid flavorant such as menthol; mixing tobacco particles, water and a gum binder with the mixture of water and sugar and with the flavorant to form a reconstituted tobacco mixture; and forming the reconstituted tobacco mixture, such as by casting or extruding the reconstituted tobacco mixture, into a reconstituted tobacco material. Exemplary menthol reconstituted tobacco products provided herein enable high levels of menthol to be retained in a tobacco product.

6 Claims, 4 Drawing Sheets

U.S. PATENT DOCUMENTS

| | | | |
|---|---|---|---|
| 4,821,749 | A | 4/1989 | Toft et al. |
| 5,137,034 | A | 8/1992 | Perfetti et al. |
| 5,137,036 | A | 8/1992 | Southwick |
| 5,144,964 | A | 9/1992 | Demain |
| 5,203,354 | A | 4/1993 | Hickle |
| 5,228,461 | A | 7/1993 | Chan et al. |
| 5,301,693 | A | 4/1994 | Chan et al. |
| 5,479,949 | A | 1/1996 | Battard et al. |
| 5,533,530 | A | 7/1996 | Young et al. |
| 5,584,306 | A | 12/1996 | Beauman et al. |
| 5,715,844 | A | 2/1998 | Young et al. |
| 5,724,998 | A | 3/1998 | Gellatly et al. |
| 6,325,859 | B1 | 12/2001 | De Roos et al. |
| 6,516,809 | B1 | 2/2003 | Schumacher |
| 7,856,988 | B2 | 12/2010 | Yang et al. |
| 2004/0118421 | A1 | 6/2004 | Hodin et al. |

FOREIGN PATENT DOCUMENTS

| | | | |
|---|---|---|---|
| EP | 0547819 | B1 | 8/1999 |
| WO | WO01/80671 | A1 | 11/2001 |

OTHER PUBLICATIONS

Spielberg, HL, "Monthly Summary for Flavor Development—901100" 1990, Philip Morris, accessed Feb. 28, 2012 http://legacy.library.ucsf.edu/tid/qzj44e00.*

Kamer, M, "Equilibrium Moisture of Reconstituted Tobacco/544" 1987, Brown & Williamson, accessed Feb. 28, 2012 http://legacy.library.ucsf.edu/tid/ybe30f00.*

International Search Report and Written Opinion mailed Jun. 12, 2007 for PCT/IB2006/003894.

International Preliminary Report on Patentability mailed May 2, 2008 for PCT/IB2006/003894.

* cited by examiner

RECONSTITUTED TOBACCO WITH BONDED FLAVORANT, SMOKING ARTICLE AND METHODS

This application is a divisional of U.S. patent application Ser. No. 11/581,492, entitled A RECONSTITUTED TOBACCO WITH BONDED FLAVORANT, SMOKING ARTICLE AND METHODS, filed on Oct. 17, 2006, now U.S. Pat. No. 7,856,988, which claims priority under 35 U.S.C. §119(e) to U.S. Provisional Application No. 60/727,458, entitled FLAVORED TOBACCO SMOKING ARTICLE AND METHODS, filed Oct. 18, 2005 and U.S. Provisional Application No. 60/727,460, entitled FLAVORED TOBACCO, SMOKING ARTICLE AND METHODS, filed Oct. 18, 2005, the entire content of each is incorporated herein by reference.

BACKGROUND

Volatile flavorings are added to tobacco products to achieve desirable organoleptic characteristics. See, for example, U.S. Pat. Nos. 3,006,347; 3,236,244; 3,344,796; 3,426,011; 3,972,335; 4,715,390; 5,137,034; 5,144,964; 5,479,949; 5,584,306; 5,724,998; 6,516,809; and 6,325,859, and commonly-owned International Publication No. WO 01/80671. The added flavorings are desirably volatilized when the tobacco products are smoked. The disclosure of U.S. Pat. No. 5,584,306 is hereby incorporated by reference.

Flavorings can be added to tobacco products during manufacturing. For example, menthol can be added to tobacco, and then tobacco rods can be formed from the mentholated tobacco. However, one problem with adding flavoring during manufacturing is that residual flavoring may undesirably remain in the manufacturing line which exacerbates the need for machine clean-up.

Another problem with adding flavorings is that flavorings can migrate and be lost during storage and distribution of tobacco products (prior to smoking of the tobacco products). The degree of migration depends on different factors including the flavoring's vapor pressure, the solubility of the flavoring in other components of the cigarette, and temperature and humidity conditions. Menthol is known to migrate to a great extent.

In addition to flavorings, various sorbent materials may be used in filters of smoking articles to remove selected constituents of tobacco smoke. Exemplary sorbent materials include activated carbons, molecular sieves, zeolites and mixtures thereof. However, volatile flavorants such as menthol tend to be drawn to and sorbed by the sorbent during the shelf-life of the smoking article.

Accordingly, there is interest in providing flavorings in tobacco products containing sorbent materials in a form less problematic to a manufacturing line, and providing reconstituted tobacco products that are less susceptible to migration prior to smoking.

SUMMARY

A reconstituted tobacco material is provided which contains a volatile flavorant, such as menthol, in tobacco. As provided herein, sugars are provided which entrap the flavoring to form a reconstituted tobacco material having a bonded flavorant (such as menthol). By entrapping the flavoring with the sugars, the flavoring can be protected from loss by migration or loss due to the proximity of sorbents. Additionally, the sugars can be used to solubilize and stabilize the flavoring such that a hydrophobic flavoring, such as menthol, can be uniformly distributed in a smoking article such as the tobacco rod of a cigarette optionally having sorbent in a filter attached to the tobacco rod.

In an embodiment, a process of manufacturing a menthol reconstituted tobacco material comprises mixing water and sugar in a heated state to form a mixture of water and sugar; providing a liquid volatile flavorant; mixing together tobacco particles, water, a natural or synthetic gum binder, the mixture of water and sugar, and the liquid volatile flavorant to form a reconstituted tobacco mixture; and forming the reconstituted tobacco mixture into a desired form of reconstituted tobacco material.

In an embodiment, the reconstituted tobacco mixture is cast into a tobacco film during the forming, and the forming further comprises drying and optionally severing the reconstituted tobacco sheet into strips or shreds.

In an embodiment, the mixture of water and sugar is maintained at a temperature of at least approximately 160 to 170° F., preferably approximately 165° F. when combined with the tobacco particles.

In an embodiment, the reconstituted tobacco mixture is held at a temperature in the range of approximately 120 to 160° F. for at least 10 minutes.

In an embodiment, the volatile flavorant comprises menthol, and the sugar comprises sucrose and/or the gum binder comprises guar gum, and/or the forming optionally further comprises: casting the reconstituted tobacco mixture into a sheet, drying the sheet, cutting or shredding the sheet into mentholated pieces, preparing a tobacco blend by combining the mentholated pieces with other blend components, and incorporating the tobacco blend into a tobacco rod.

In an embodiment, the sugar and water mixture contains 10 to 45% by weight of the water and 55 to 90% by weight of the sugar, and/or the tobacco particles, the water and the gum binder are premixed in a ratio that contains 5 to 60% by weight of tobacco particles, 3 to 12% of the gum binder and 28 to 92% by weight of the water.

In an embodiment, the flavorant is menthol and the reconstituted tobacco mixture comprises a slurry which contains 20 to 60% by weight solids and 40 to 80% water, the solids comprise 5 to 50% or 10 to 30% by weight menthol, 10 to 50% or 30 to 50% by weight sugar, 10 to 70% or 20 to 40% by weight tobacco particles, and 3 to 12% or 5 to 10% by weight binder.

In an embodiment, the forming further comprises extruding the reconstituted tobacco mixture into pellets, transforming the pellets into shreds and drying the shreds.

In an embodiment, the reconstituted tobacco material is conditioned by holding the reconstituted tobacco material for a predetermined time and/or treating the reconstituted tobacco material with vacuum and/or heat to remove at least some surface flavorant.

In an embodiment, a mentholated smoking article such as a cigarette optionally containing a sorbent in a filter of the cigarette, comprises shreds of sugar encapsulated menthol, the shreds comprising 85 to 95% by weight solids and 5 to 15% by weight water, the solids comprising 5 to 50% or 10 to 30% by weight menthol, 10 to 50% or 30 to 50% by weight sugar, 10 to 70% or 20 to 40% by weight tobacco particles, and 3 to 12% or 5 to 10% by weight gum binder.

In an embodiment of the mentholated smoking article, the sugar is sucrose and the gum binder is guar gum. In an embodiment, the shreds exhibit loss of retention of menthol of less than 50% after exposure to atmospheric air for 3 hours at 50° C.

In an embodiment, shreds of sugar encapsulated menthol comprise 85 to 95% by weight solids and 5 to 15% by weight water, the solids comprise 5 to 50% or 10 to 30% by weight menthol, 10 to 50% or 30 to 50% by weight sugar, 10 to 70% or 20 to 40% by weight tobacco particles, and 3 to 12% or 5 to 10% by weight gum binder. In an embodiment, the sugar is sucrose and the gum binder is guar gum. In an embodiment, the shreds exhibit loss of retention of menthol of less than 50% after exposure to atmospheric air for 3 hours at 50° C.

In an embodiment, a method of treating mainstream smoke produced by a smoking article, comprises: heating or combusting a tobacco mixture containing shreds of sugar encapsulated menthol, the shreds comprising 85 to 95% by weight solids and 5 to 15% by weight water, the solids comprising 5 to 50% or 10 to 30% by weight menthol, 10 to 50% or 30 to 50% by weight sugar, 10 to 70% or 20 to 40% by weight tobacco particles, and 3 to 10% or 5 to 10% by weight gum binder.

In an embodiment, mentholated tobacco material is made by commingling tobacco particles, a gum binder, menthol in a liquid state, and a heated mixture of sugar in water. In an embodiment, the tobacco particles are combined with guar prior to the commingling step.

In an embodiment, a cigarette comprises a blend of cut filler and a wrapper about the cut filler, the blend including the mentholated tobacco material.

In an embodiment, a system for retaining menthol in a smoking article comprises: tobacco particles, a sugar encapsulated menthol, and a gum binder, the tobacco particles, sugar encapsulated menthol and gum binder dispersed amongst a dried tobacco sheet matrix.

In another embodiment, a process of manufacturing a reconstituted tobacco material, comprises the steps of: supplying tobacco particles, water and a gum binder to a mixer; supplying a water and sugar mixture to the mixer; supplying a liquid volatile flavorant to the mixer; combining the tobacco particles, the water, the gum binder, the water and sugar mixture, and the liquid volatile flavorant in the mixer to form a slurry; supplying the slurry to an arrangement for forming a uniform layer of the slurry; drying the uniform layer of the slurry in a dryer to form a continuous sheet; and shredding or cutting the continuous sheet into pieces.

In an embodiment, the arrangement for forming a uniform layer of the slurry comprises a reverse roll coater. The mixer has a shear of less than about 10,000 reciprocal seconds. The reverse roll coater comprises a metering roll, a casting roll and a rubber roll and the metering roll has a speed of about 30 rpm and the rubber roll has a speed of about 50 rpm.

In an embodiment, the tobacco particles, the gum binder and the water are supplied to the mixer generally at a first end of the mixer, the water and sugar mixture and the liquid volatile flavorant are supplied to the mixer generally at a middle of the mixer, and the slurry is supplied by the mixer from a second end of the mixer.

In an embodiment, the tobacco particles supplied to the mixer have been ground to enable about 95% of the tobacco particles to pass through a 120 mesh screen, the gum binder comprises guar, and the slurry supplied by the mixer has generally 27% solids.

In an embodiment, the slurry is supplied by the mixer to a tank before the slurry is supplied to the reverse roll coater, the slurry resides in the tank generally for about 10 to 90 minutes to hydrate components of the slurry.

In an embodiment, the liquid volatile flavorant is menthol which has been heated to about 120° F. and the water and sugar mixture is a mixture of sucrose and 20 to 30% water which has been heated to a temperature in the range of approximately 160 to 170° F.

In an embodiment, the reverse roll coater forms a film having a thickness of about 0.020" to 0.030" and the film is dried to about 90% solids before being cut into pieces.

DETAILED DESCRIPTION

According to an embodiment, a reconstituted tobacco material is made from a mixture of a flavoring-sugar solution and a tobacco slurry. The reconstituted tobacco material can retain much of the flavoring throughout storage and handling of the reconstituted tobacco material, but can release flavoring upon combustion, thermal degradation, and/or physical degradation.

Figure 1:
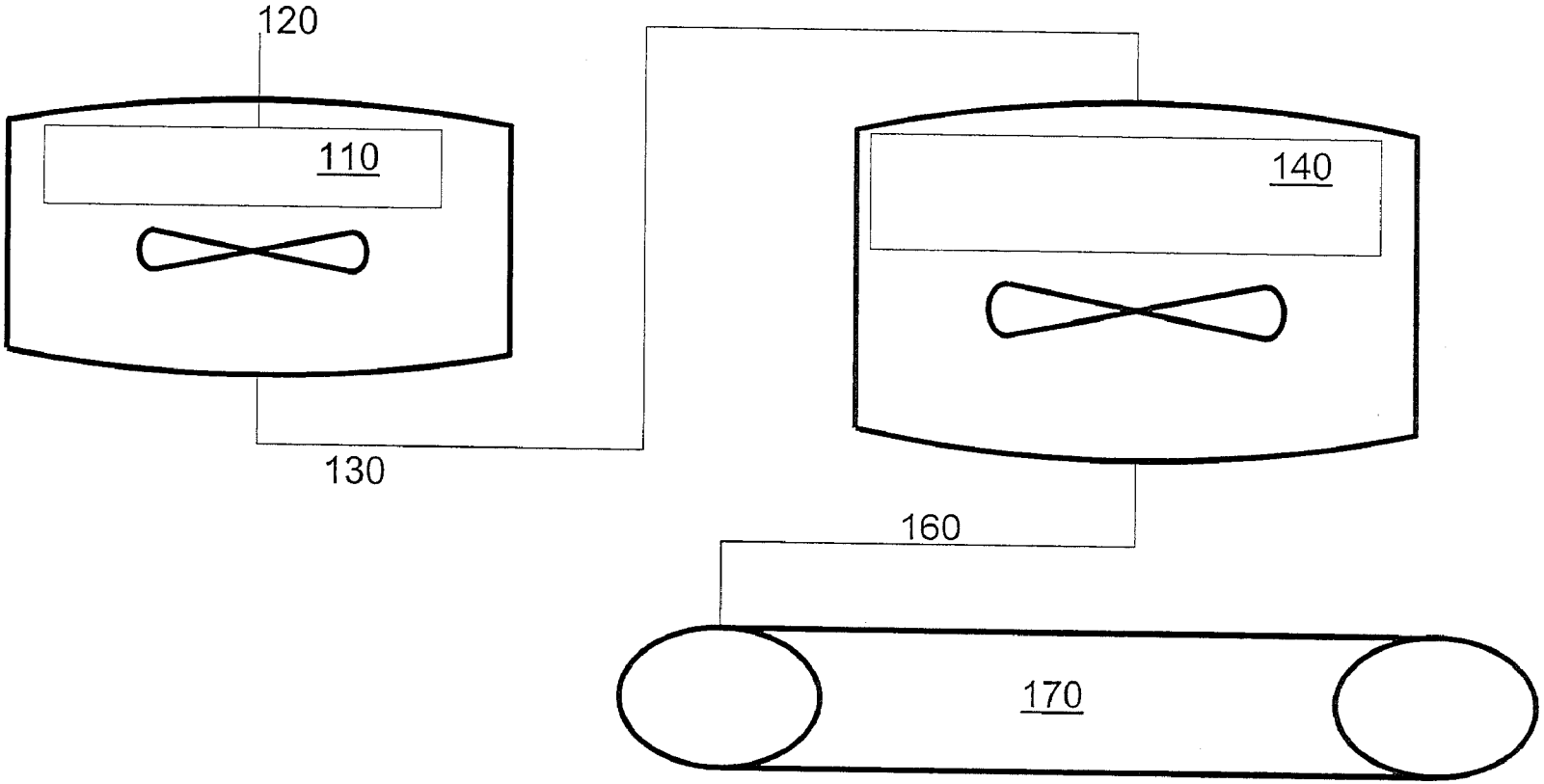
FIG. 1 is a graphical representation of an exemplary process of manufacturing a reconstituted tobacco material.

According to one embodiment, in preparing the reconstituted tobacco material, as illustrated in FIG. 1, a first mixture 110 of water and sugar is prepared. The first mixture 110 is formed by heating (melting) sugar in the presence of a small amount of water, wherein the amount of water is enough to prevent charring and/or burning of the sugar, but not enough to fully dissolve the sugar without the provision of heat. For example, sucrose can be heated to about 225° F. (i.e., the boiling point of the solution) with water to form a clear liquid of melted sucrose. Preferably, the first mixture 110 consists essentially of water and sugar and is maintained at a temperature above 200° F. In exemplary embodiments, the first mixture 110 contains 10 to 45% by weight of the water and 55 to 90% by weight of the sugar, preferably sucrose.

Next, a second mixture 130 is formed by adding a volatile flavoring (such as menthol) 120 to the first mixture 110. The second mixture 130 can be formed by mixing the flavoring 120 (liquid or solid flavoring) into the first mixture 110 (heated sugar solution), such that the flavoring 120 can be entrapped within the heated sugar solution. Preferably, the first mixture 110 is maintained at a temperature above 200° F. when the flavoring 120 is added thereto in order to solubilize the flavoring 120 into the second mixture 130. In exemplary embodiments, the second mixture 130 contains 5 to 55% by weight of the flavoring 120, preferably menthol.

For example, a hydrophobic, relatively non-polar volatile flavorant, such as menthol, can be dissolved and solubilized into a heated sucrose solution based upon the heat of the solution and the use of the sucrose. It is noted that by providing the flavoring 120 in the second mixture 130, the flavoring 120 can be entrapped within a sugar matrix.

Next, a third mixture 140 of tobacco slurry comprising tobacco particles, water and gum binder is formed. For example, the third mixture 140 can be formed by mixing tobacco particles with a gum binder, preferably guar gum, and water. In exemplary embodiments, the third mixture 140 can contain 5 to 60% by weight of tobacco particles, 3 to 12% of binder and 31 to 92% by weight of water, all of which are mixed to form the third mixture 140 preferably below 100° F. (e.g., at ambient temperature).

Next, a fourth mixture 160 is formed comprising the third mixture 140 and the second mixture 130. In exemplary embodiments, the second mixture 130 is maintained at a temperature above 200° F., while the third mixture 140 is maintained at a temperature below 100° F. until mixing, wherein upon forming the fourth mixture 160, the fourth mixture 160 would have a temperature above ambient. In an exemplary embodiment, a second mixture 130 with menthol and sucrose at approximately 225° F. can be combined with a third mixture 140 of tobacco particles, guar gum and water at below 80° F. to form a fourth mixture 160 at a temperature of 150 to 165° F. In exemplary embodiments, the fourth mixture 160 can comprise a slurry which contains 20 to 60% by weight solids, wherein the solids comprise 5 to 50% by weight flavorant (preferably 10 to 30% flavorant), such as menthol, 10 to 50% by weight sugar (preferably 30 to 50% sugar), such as sucrose, 10 to 70% by weight tobacco particles (preferably 20 to 40% tobacco particles) and 3 to 12% by weight gum binder (preferably 5 to 10% gum binder), such as guar gum. Preferably, the gum binder includes, but is not limited to, binders such as guar gum and known substitutes for guar gum such as xanthan gum, gum arabic, tamarind, locust bean gum, and the like.

It is noted, however, that the fourth mixture 160 can be formed in other ways than that mentioned above. In an exemplary embodiment, the flavoring 120 can be kept separate from the first mixture 110, wherein the first mixture 110, the volatile flavoring 120 and the third mixture 140 can be added individually to form the fourth mixture 160. For example, a first feed line with the first mixture 110, a second feed line with the flavoring 120 and a third feed line with the third mixture 140 can be fed into a vat and mixed to form the fourth mixture 160.

It is noted that if a hydrophobic volatile flavoring, such as menthol, is provided, then the hydrophobic volatile flavoring would not ordinarily be solubilized with a water-based solution like the third mixture 140. Rather, the hydrophobic volatile flavoring would tend to segregate from the water-based third mixture 140 resulting in a non-uniform distribution of the flavoring 120 in the fourth mixture 160. However, by combining the second mixture 130 and the third mixture 140, the hydrophobic volatile flavoring can be mixed uniformly to form the fourth mixture 160.

Next, the fourth mixture 160 can be optionally aged prior to further processing such as casting or extruding 170 the fourth mixture 160. In an exemplary embodiment, the fourth mixture 160 can be aged to hydrate the binder. For example, the fourth mixture 160 mentioned above can be aged at a temperature above 150° F. for at least 10 minutes. In an exemplary embodiment, a fourth mixture 160 including guar gum, menthol, tobacco and water can be aged at about 150 to 165° F. for 15 minutes to hydrate the guar gum.

After the optional aging step, the fourth mixture 160 can be formed into sheet, strip, filaments, pellets, shreds and/or cut filler or other form of tobacco material by any suitable technique. For example, the fourth mixture can be cast or extruded 170. The fourth mixture 160 can be cast to form a reconstituted tobacco sheet by hand or using a machine. Alternatively, in order to extrude 170 the fourth mixture 160, the fourth mixture 160 can be extruded through an extruder into any shape, such as a shape similar to cut filler or filamentary or other shapes. In exemplary embodiments, the fourth mixture 160 can be extruded into pellets, then rolled and/or shredded into shreds, and the shreds can be dried and incorporated with cut filler into a tobacco rod.

After forming a sheet of reconstituted tobacco (or a shaped reconstituted tobacco material), the reconstituted tobacco material can be dried and further shaped and/or cut. An exemplary reconstituted sheet can include 85 to 95% by weight solids and 5 to 15% by weight water, wherein the solids comprise 5 to 50% by weight menthol (preferably 10 to 30% menthol), 10 to 50% by weight sugar (preferably 30 to 50% sugar), 10 to 70% by weight tobacco particles (preferably 20 to 40% tobacco particles) and 3 to 12% by weight gum binder (preferably 5 to 10% gum binder). It is noted that the water (moisture) content is desirably 5 to 15% by weight of the sheet such that the sheet retains flexibility and robustness. For example, the reconstituted tobacco can be dried to a level of 5 to 15% by weight water by casting and drying the sheet using a fluidized bed dryer, steam dryers or steam plates at about 100° C.

Preferably, the reconstituted tobacco sheet is cut to form strips that are cut simultaneously with other forms of tobacco strips to form a mixed cut filler (i.e., a mixture of the cut reconstituted tobacco sheet and the other cut tobacco strips) that can be used to manufacture a reconstituted tobacco product, such as a menthol tobacco rod, etc., as desired. Alternatively, the reconstituted tobacco sheet may be cut independently to form a reconstituted tobacco cut filler component, and then the reconstituted tobacco cut filler component can then be blended with other filler components.

By providing the flavoring 120 in the second mixture 130, the sugar can stabilize and entrap the flavoring 120, thus resulting in lower flavor migration levels, a higher flavoring yield and less inactivation of sorbent in a tobacco product having a sorbent such as activated carbon. Additionally, by stabilizing the flavoring 120 in the reconstituted tobacco material and then adding cut or shaped reconstituted tobacco material to traditional cut filler, loss of flavor likely when adding flavoring 120 directly to such cut filler can be substantially avoided. Importantly, the tendency of volatile flavoring such as menthol to migrate is abated.

Additionally, by stabilizing and entrapping the flavoring 120 with a sugar, the desirable characteristics of the sugar can be used for flavor release. For example, sugars have a low melting temperature, therefore when heat from combustion or heating of a tobacco product reaches the sugars, the sugars degrade and release the flavoring 120.

The proportions of the components can be widely varied prior to mixing the reconstituted tobacco material with cut filler. For example, shreds of sugar encapsulated flavorant can be incorporated into the smoking article wherein the shreds comprise 85 to 95% by weight solids and 5 to 15% by weight water, wherein the solids comprise 5 to 50% by weight flavorant (preferably 10 to 30% flavorant), such as menthol, 10 to 50% by weight sugar (preferably 30 to 50% sugar), such as sucrose, 10 to 70% by weight tobacco particles (preferably 20 to 40% tobacco particles) and 3 to 12% by weight gum binder (preferably 5 to 10% gum binder), such as guar gum.

Any number of volatile flavorings are suitable for use in the reconstituted tobacco products provided herein. In exemplary embodiments, menthol is the preferred flavoring. The term "menthol" includes synthetic or natural menthol. For example, menthol can be a volatile compound selected from the various menthol compounds disclosed in U.S. Pat. Nos. 3,111,127, 3,126,012, 3,128,772 and 3,139,888 the disclosures of which are hereby incorporated by reference it their entireties. Other suitable volatile flavorings include mint, such as peppermint and spearmint, vanillin, chocolate, licorice, citrus and other fruit flavors, spice flavors, such as cinnamon, methyl salicylate, linalool, bergamot oil, geranium oil, lemon oil, ginger oil, tobacco flavors and other agents commonly used to impart flavor and aroma to the mainstream smoke of tobacco products. Flavorings suitable for entrapment are also discussed in commonly assigned U.S. Pat. Nos. 5,301,693, 5,228,461, and 5,137,036, which are hereby incorporated by reference in their entireties.

Any number of sugars are suitable for use in reconstituted tobacco material. Exemplary examples include simple sugars, such as fructose, glucose, etc., and disaccharides, such as sucrose, lactose, etc. Additionally, other sugars capable of entrapping and stabilizing flavorings therein can be used provided that entrapment and stabilization can occur, as well as temperature release of the flavorings.

The tobacco particles added to the third mixture can comprise tobacco dust, stems, by-products and the like that are finely ground and optionally used in reconstituted tobacco. The tobacco particles can range in particle size from 30 to 400 mesh, preferably from 60 to 120 mesh. Examples of reconstituted tobacco materials and manufacturing methods can be found in commonly-assigned U.S. Pat. Nos. 5,584,306 and 5,724,998, which are incorporated herein for all purposes.

Additionally, suitable binders can include water-soluble binders such that the binder can be used in a water-based slurry and are preferably natural and/or synthetic gums. Examples of suitable binders include, but are not limited to, water-soluble polysaccharides, such as guar gum, xanthan gum, locust bean gum, gum arabic, tamarind gum, alginate, pectin, etc. Examples of binders used in reconstituted tobacco products can be found in commonly-assigned U.S. Pat. Nos. 5,584,306 and 5,724,998, which are incorporated above.

A reconstituted tobacco material can be blended with other tobaccos to form cut filler, as mentioned above, to form a reconstituted tobacco product such as a menthol cigarette. Such cut filler may include, but is not limited to, shreds of flue-cured tobacco, Burley tobacco, Maryland tobacco, Oriental tobacco, rare tobacco, specialty tobacco, reconstituted tobacco, expanded tobacco and the like. The cut filler can also include conventional additives, e.g., humectants, such as glycerine, propylene glycol, etc.

While not wishing to be bound by theory, it is believed that entrapment and stabilization of the flavoring by sugars is based on the principle of reducing segregation of the flavorings in the fourth mixture 160. By providing the sugars in melted rather than dissolved form, the sugars can entrap volatile flavorings and act as a type of surface active agent for the flavorings, thus allowing the flavorings to be distributed in the fourth mixture 160 when the flavoring 120 might otherwise coagulate with itself and not be distributed. It is believed that the sugars interact with the flavorings to form a sugar matrix entrapping and stabilizing the flavoring to aid in the solubilization and incorporation of the flavoring into a water-based slurry for forming a reconstituted tobacco material.

Additionally, while again not wishing to be bound by theory, it is believed that the provision of a binder in the third mixture 140 can also aid in the solubilization and incorporation of the flavoring into the fourth mixture 160. It is believed that the binder can interact with the sugar matrix, and that the binder can further aid the sugar matrix in entrapping and stabilizing the flavoring for mixing with the water-based third mixture 140.

Figure 2:
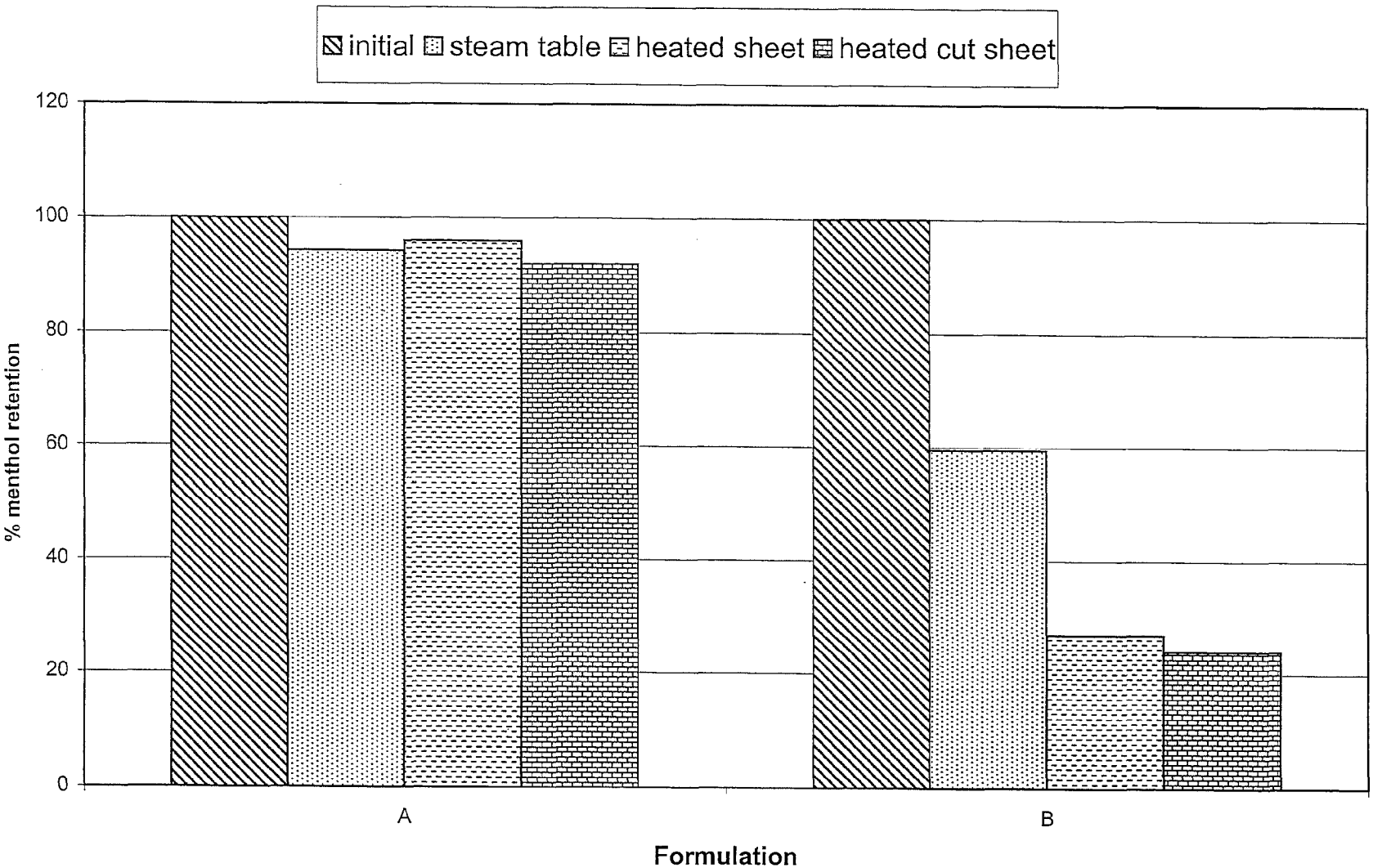
FIG. 2 is a graph illustrating menthol retention for a reconstituted tobacco sheet and a cut reconstituted tobacco sheet (shreds) comparing different gum binder level formulations.

Irrespective of theory, and referring to FIG. 2, higher levels of guar content can promote a higher level of menthol retention. As illustrated in FIG. 2, in particular, two mentholated tobacco sheets were constructed according to a Formulation "A" (on a dry weight basis) with approximately 30% menthol, approximately 40% sucrose, approximately 23% tobacco particles (120 mesh blended tobacco) and 7% guar. As illustrated in FIG. 2, the "initial" sheet menthol level of Formulation "A" acts as the control with a menthol retention of 100%. After the initial sheet is dried using a steam table at about 100° C., the "steam table" sheet has a menthol retention of about 90%. Next, one of the dried sheets was shredded into shreds with a size approximating that of typical cut filler sheets (approximately 30 cuts per square inch), wherein both the sheet and the shreds of the shredded sheet (or "cut sheet") were placed in an oven at 50° C. for 24 hours. Both the heated sheet and the heated cut sheet showed over 90% retention of menthol even after the application of heat.

However, in Formulation "B" when the guar content was halved (to approximately 3.5% dry weight guar with approximately 30% menthol, approximately 40% sucrose and approximately 26.5% tobacco particles), the sheets were treated in the same manner as Formulation "A", and the menthol retention dropped significantly after drying and an application of heat (oven at 50° C. for 24 hours). This result is illustrated in FIG. 2, wherein the steam table sheet has a menthol retention of about 60%, while the heated sheet and the heated cut sheet have a menthol retention of about 30%.

EXAMPLE

An exemplary reconstituted tobacco material (hereinafter the "mentholated sheet") can be formed by:

1) heating about 40 grams of sucrose in about 12 grams of water to a temperature of about 225° F.;

2) maintaining the temperature at about 225° F. while mixing in about 30 grams of menthol;

3) mixing the menthol-sucrose-water combination in a Waring blender at high speed for about 1 minute to form a clear liquid;

4) separately mixing a tobacco slurry by combining about 23 grams of tobacco particles, about 7 grams of guar gum and about 288 grams of water at about 70° F.;

5) combining the menthol-sucrose-water combination with the tobacco slurry to form a final slurry, wherein the temperature of the final slurry is 150 to 165° F.;

6) aging the final slurry for about 15 minutes at a temperature of 150 to 165° F. to hydrate the guar gum;

7) casting the final slurry onto a flat surface to form a wet sheet; and 8) drying the wet sheet to form a mentholated sheet.

The resulting exemplary mentholated sheet can be cast to a thickness of about 0.1 mm to about 0.5 mm in order to provide sufficient robustness in the sheet, while also providing sufficient flexibility and formability for the sheet. Additionally, the exemplary mentholated sheet can be shredded into shreds with flavor retention results similar to those of the mentholated sheet.

By providing the mentholated sheet as formed above, high levels of menthol flavoring can be retained even after exposure to air and/or heat. For example, the exemplary mentholated sheet has an initial level of about 30% menthol. After exposing an exemplary mentholated sheet to air at about 50° C. (i.e., 122° F.) for 3 to 24 hours, about 90% of the menthol remained in the sheet.

It is believed that the loss of about 10% menthol after about 3 hours is surface menthol because as the exposure continues up to about 24 hours, further menthol loss does not appear to occur. Additionally, after exposing another exemplary mentholated sheet to an air flow for about 17 days, about 83% retention resulted. Thus, while not wishing to be bound by theory, it is believed that the exemplary mentholated sheet loses menthol initially only through exposed surface area and the sucrose matrix stabilizes and entraps the remaining menthol therein.

Figure 4:
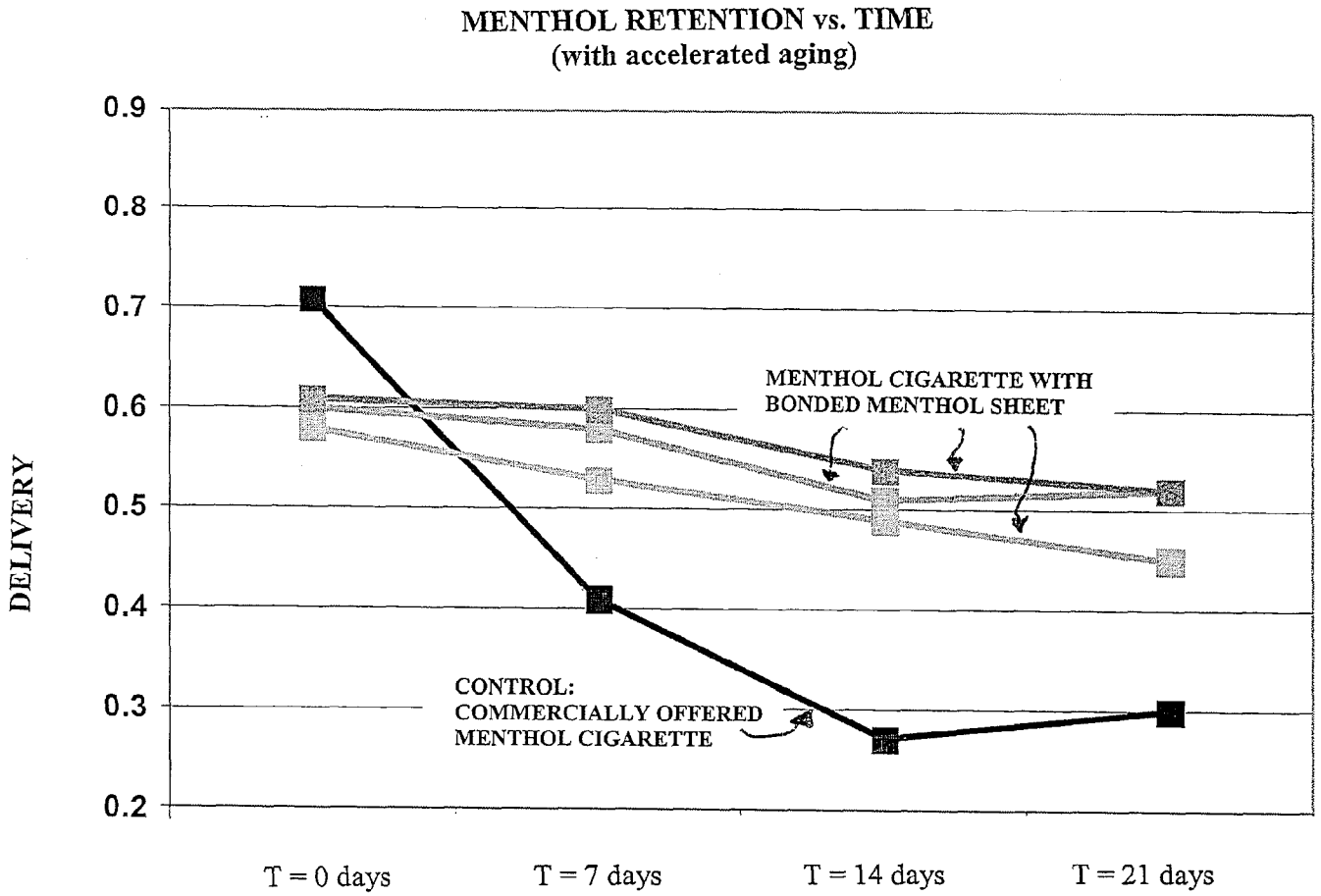
FIG. 4 is a graph of menthol retention versus time (with accelerated aging) for menthol cigarettes with bonded menthol sheet and a control commercially offered menthol cigarette.

With reference to FIG. 4, a graph of menthol retention versus time (with accelerated aging) is provided for three menthol cigarettes with bonded menthol sheet and a control cigarette which is a commercially offered menthol cigarette. Although the control cigarette initially had a higher menthol delivery, at 7 days, 14 days and 21 days, the control cigarette had noticeably lower menthol delivery as compared with the menthol cigarettes with the bonded menthol sheet.

Although mentholated sheets of the preferred embodiment are suitable for immediate entry into cigarette manufacturing operations and the like, the sheet may instead be held for sufficient time and/or treated with vacuum and/or heat (collectively called "further conditioning") to remove the removable "surface menthol" prior to use in manufacturing operations. By doing so, the "surface menthol" is no longer available to migrate within the manufactured smoking article (cigarette) to impact adsorbents or the like nor allowed to deposit on manufacturing machinery.

In an exemplary embodiment, the mentholated sheet with an initial menthol content of about 30% menthol can be cut into shreds after the sheet is dried to a water content of between 12 and 20% by weight of the shreds. After exposing the exemplary shreds to air at about 50° C. (i.e., 122° F.) for 3 to 24 hours, about 75% of the menthol remained. Additionally, after exposing other exemplary shreds to an air flow for about 17 days, about 75% retention occurred. While it is believed that other exemplary shreds of mentholated sheet should exhibit menthol retention similar to those listed above, it is believed that at least 50% menthol retention can be expected for shreds of mentholated sheets of different initial menthol contents; thus, a loss of less than 50% menthol is expected.

For comparison purposes, a cast leaf reconstituted tobacco sheet of similar tobacco, guar gum and water content was formed, but without the initial steps of forming a menthol-sucrose solution. Instead the menthol was added directly to the tobacco slurry. After forming a comparative sheet from the slurry, the comparative sheet was exposed to air at about 50° C. for about 3 hours. As a result, almost all of the menthol was lost.

In contrast, an exemplary mentholated sheet prepared in accordance with the Example appeared to lose much of its initial menthol scent when exposed for approximately 3 hours to air at about 50° C. and thereafter to an air flow for about 17 days. Thereupon, the mentholated sheet had only a vague scent of menthol. However, when the mentholated sheet was crushed, the menthol scent was noticeable. Additionally, when the mentholated sheet was combusted or heated to a sufficiently high temperature so as to degrade the sucrose, the menthol was released and a menthol scent was again noticeable.

It should be understood that all ranges discussed herein are approximate. For example, in an embodiment, a mentholated smoking article comprises shreds of sugar encapsulated menthol, the shreds comprising approximately 85 to 95% by weight solids and approximately 5 to 15% by weight water, wherein the solids comprise approximately 5 to 50% by weight menthol (preferably, approximately 10 to 30% menthol), approximately 10 to 50% by weight sugar (preferably, approximately 30 to 50% sugar), approximately 10 to 70% by weight tobacco particles (preferably, approximately 20 to 40% tobacco particles) and approximately 3 to 12% by weight gum binder (preferably, approximately 5 to 10% gum binder). All other recitations of ranges throughout the application should be understood to include the same approximation of ranges.

It should also be understood that the weight ranges used herein are on a dry weight basis. For example, in an embodiment, a mentholated smoking article comprises shreds of sugar encapsulated menthol, the shreds comprising 85 to 95% by weight solids and 5 to 15% by weight water, wherein the solids comprise on a dry weight basis 5 to 50% by weight menthol (preferably, on a dry weight basis 10 to 30% menthol), on a dry weight basis 10 to 50% by weight sugar (preferably, on a dry weight basis 30 to 50% sugar), on a dry weight basis 10 to 70% by weight tobacco particles (preferably, on a dry weight basis 20 to 40% tobacco particles) and on a dry weight basis 3 to 12% by weight gum binder (preferably, on a dry weight basis 5 to 10% gum binder).

Figure 3:
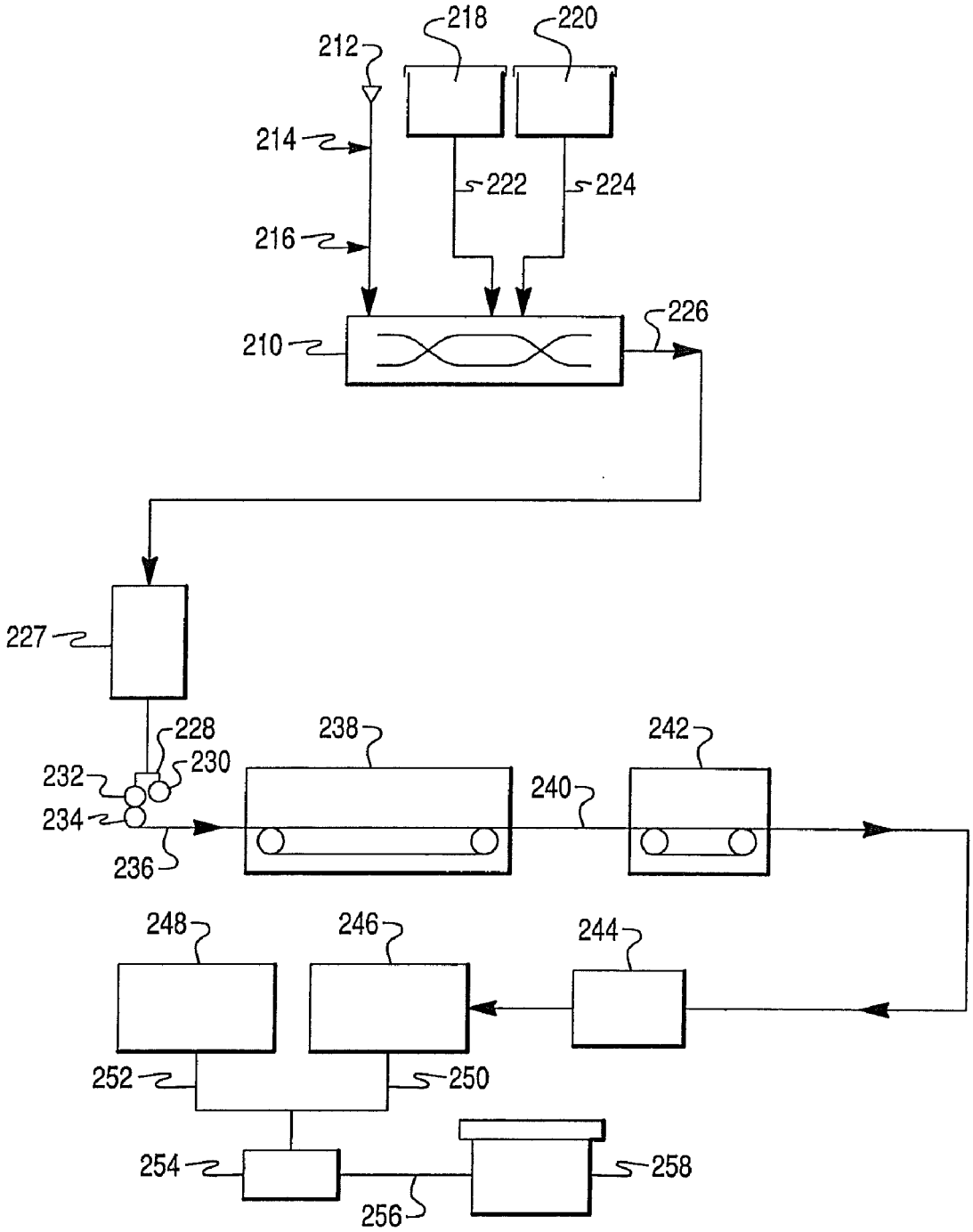
FIG. 3 is a graphical representation of another exemplary process of manufacturing a reconstituted tobacco material.

According to another embodiment, in a process and arrangement for preparing the reconstituted tobacco material, as illustrated in FIG. 3, tobacco dust is supplied through a conduit 212. Guar is added to the conduit 212 containing the tobacco dust through a conduit 214. In addition, water is supplied to the conduit containing the tobacco dust and guar through a conduit 216. Preferably, the tobacco dust, guar and water are supplied generally to the front end of a paddle mixer 210.

The tobacco dust is preferably a mixture of stem and reclaimed tobacco which has been ground so that 95% will pass through a 120 mesh screen. Generally any finely ground tobacco can be used for the tobacco dust introduced through the conduit 212. The amount of tobacco dust which is introduced is controlled by a loss-in-weight feeder (not shown). The amount of tobacco dust supplied to the paddle mixer 210 is controlled so that the material coming out of the paddle mixer 210 has a desired and predetermined range of tobacco dust as a component of the material.

The guar that is added through the conduit 214 is medium to fast hydrating guar which is readily available commercially such as Aqualon G2S. The guar is supplied through a loss-in-weight feeder (not shown) so that the supply of guar is controlled (like the supply of tobacco dust) so that the material coming out of the paddle mixer 210 has a desired and predetermined amount of guar as a component of the mixture.

Before the tobacco dust and guar enter the paddle mixer 210, water is supplied through a conduit 216. The water is heated to about 175° F. or less in order to control the viscosity of the material slurry at a reverse roll coater 228 which is downstream of the paddle mixer 210. The amount of water supplied is controlled through a flow meter (not shown) and the temperature of the water is controlled so that the slurry mixture going into the reverse roll coater has a temperature of about 130° F. and a moisture content of about 73% by weight (i.e., about 27% solids).

The tobacco dust, guar and water are introduced into the inlet, end of the paddle mixer 210. The paddle mixer is, for example, a slurry paddle mixer such as the Munson Hi-Intensity Mixer available from the Munson company of Utica, N.Y. The tobacco dust, guar and water enter the paddle mixer continuously with a residence time of about 3 to 5 minutes in the paddle mixer. The paddle mixer is operated with a relatively low shear of about 5000 to 10,000 sec-1 (i.e., 5000 to 10,000 reciprocal seconds) in order to avoid forming a foam in the mixture.

Preferably, the melted menthol is in a condition of having been heated to a temperature at which it is a liquid. In the embodiment illustrated in FIG. 3, melted menthol is provided in a tank 218 and supplied to the paddle mixer 210 through a conduit 222. Similarly, a heated mixture of sucrose and water is provided in a tank 220 and supplied to the paddle mixer 210 though a conduit 224. The melted menthol and the mixture of sucrose and water are introduced into the paddle mixer generally at a mid-point of the paddle mixer but the menthol and mixture of sucrose and water may be introduced earlier or together with the tobacco dust, guar and water, if desired.

The melted menthol is provided by menthol pellets which are heated to about 120° F. and preferably less than about 140° F. The shelf-life of menthol deteriorates if the menthol is maintained at a temperature above about 140° F. for a sustained period of time. The quantity of melted menthol that is supplied through the conduit 222 is controlled by a flow meter (not shown) so that the slurry mixture leaving the paddle mixer and leaving the reverse roll coater 228 has a preferred amount of menthol, as discussed below.

The sucrose and water mixture is obtained by mixing sucrose granules and water with agitation (not shown) preferably at a ratio of about 77% sucrose and 23% water so as to provide a clear liquid of the sucrose/water mixture. The sucrose to water ratio may be varied to contain from about 20% water to about 35% water. The water and sugar mixture is heated to at least 180° F., but preferably not beyond 200° F. or 210° F. to avoid degradation. Preferably, for purposes of facilitating manufacturing, the temperature is reduced to about 165° F. Upon completion of this treatment, the sugar water mixture becomes a liquid that is essentially crystal-free and mostly clear, but sometimes with a brown tint. The quantity of sucrose/water mixture supplied by the conduit 224 is controlled by a flow meter (not shown) so that the slurry mixture leaving the paddle mixer and leaving the reverse roll coater 228 has a preferred amount of sucrose, as discussed below.

In this embodiment, the mixture leaving the paddle mixer 210 has 27% solids which is the target for a desired viscosity of the mixture at the reverse roll coater 228. Similarly, the material leaving the reverse roll coater likewise has 27% solids. The solids in the mixture comprise about 7% guar, 49% sugar, 15% to 30% menthol and the remainder (i.e., 29% to 14%) comprising tobacco dust so that the mixture has 27% solids.

The melted menthol and the sucrose/water mixture are maintained in separate tanks 218, 220 because the menthol is an "oil" which does not readily mix with the sucrose/water liquid.

The mixture leaving the paddle mixer 210 is supplied through piping (which is preferably insulated) to a slurry surge or holding tank 227. The tank 227 is preferably insulated so that the temperature of the mixture in the tank is generally maintained. The mixture resides in the tank 227 for at least about 15 minutes to a maximum of about 3 hours with the typical residence time for the mixture in the tank 227 being between 10 and 90 minutes and most preferably about 30 minutes. The mixture is provided to the tank 227 in order to allow the components of the mixture, such as the guar and tobacco dust, to fully hydrate. The tank 227 is oriented generally vertically so that the mixture flows downwardly through the tank by gravity. In the embodiment of FIG. 3, there is no mixing provided within the tank 227.

The mixture is then supplied from the bottom of the tank 227 to the reverse roll coater 228. In the reverse roll coater, three rollers are provided to apply a film of the mixture to a continuous belt (not shown) at a controlled thickness. In the embodiment of FIG. 3, the film has a thickness of 0.025", preferably between about 0.020" to 0.030". The reverse roll coater is of suitable, conventional design such as the reverse roll coaters available from Ross but the speeds of the various rolls are adjusted so as to reduce the shear resulting from the coating operation.

The temperature and viscosity of the mixture is controlled generally by controlling the amount and temperature of water supplied to the paddle mixer 210 so that the mixture entering the reverse roll coater is at a temperature of about 130° F. and the mixture has a ratio of 73% moisture and 27% solids measured by weight.

In the reverse roll coater 228, the three rolls comprise a metering roll 230 (typically made of steel), a casting roll 232 (typically made of steel), and a rubber roll. The metering roll 230 and the casting roll 232 form a nip and both rolls rotate in the same direction (e.g. clockwise). In this way, the casting roll pulls the mixture downwardly and the metering roll urges the mixture upwardly so that a uniform film of mixture passes through the nip between the casting roll and the metering roll.

In the embodiment of FIG. 3, the casting roll 232 rotates at the normal or conventional speed for the reverse roll coater but the metering roll is rotated at an increased speed. For example, in the embodiment of FIG. 3, the speed of the metering roll 230 was increased from the conventional speed of 10 rpm to 30 rpm.

The rubber roll 234 is provided generally beneath the casting roll 232. The rubber roll 234 also rotates clockwise in the embodiment of FIG. 3 and transfers the mixture from the casting roll 232 onto a steel belt (not shown) in the conventional manner of a reverse roll coater. The rubber roll 234 rotates in a direction which is opposite the direction of travel of the steel belt onto which the mixture is transferred. However, the speed of the rubber roll 234 is reduced in the embodiment of FIG. 3 to about half the normal speed for the rubber roll 234. For example, in the embodiment of FIG. 3, the speed of the rubber roll 234 is reduced from about 100 rpm to about 47 rpm.

In this way, by adjusting the speeds of the metering roll 230 and the rubber roll 234, shear imposed on the mixture by the reverse roll coater is significantly reduced so that the mixture is applied in a significantly uniform manner. Due to the sucrose and menthol component of the mixture, the rheology of the mixture makes a relatively low shear process preferable. The speeds of the metering roll and the rubber roll in the reverse roll coater are changed with respect to a conventional reverse roll coater so that the reverse roll coater has a relatively low shear effect on the mixture.

A tank (not shown) is provided above the nip formed by the casting roll 232 and the metering roll 230 to supply the mixture to the nip. In the embodiment of FIG. 3, an oscillating feed tube (not shown) supplies the mixture to the tank provided above the nip of the casting roll 232 and the metering roll 230.

The rubber roll 234 rotates at a surface speed which is considerably faster than the surface speed of the steel belt onto which the mixture is provided. In a demonstration configuration or pilot plant operation, the steel belt is about 18 inches wide and the steel belt travels at about 38 feet per minute. In a commercial operation, the steel belt may preferably be about 60 inches wide with the steel belt traveling at about 150 feet per minute.

The steel belt carries the mixture through a primary gas fired air impingement dryer such as a dryer provided by Berndorf of Elgin, Ill. The solid stainless steel belt carries the mixture film through the dryer but the air impingement is arranged so that the air is directed only at the underside of the stainless steel belt and not directly onto the mixture film. In the embodiment of FIG. 3, providing air impingement directly to the film mixture could result in a glaze at the surface of the mixture film which inhibits the drying of the film. The temperature of the air directed to the underside of the stainless steel belt is arranged into multiple temperature zones which creates a drying gradient such that the film leaves the dryer 238 at the desired exit moisture content.

The film is resident within the dryer 238 for about a minute during which time moisture is removed from the film to change the percentage solids from about 27% to about 70% solids. At the end of the dryer 238, the now semi-dried film or sheet is removed from the stainless steel belt by a doctor blade (not shown) and the sheet or film is transferred to a stainless steel mesh (or chain) belt (not shown). The stainless steel mesh belt conveys the sheet or film through a secondary gas fired air impingement dryer 242 (also called a chain dryer or "C" dryer). In the dryer 242, the air impingement is provided both above and below the film or sheet and the temperature of the air ranges from about 300° F. to about 350° F. The residence time of the film or sheet in the second dryer 242 is about 30 seconds in the embodiment of FIG. 3.

The temperatures at various stages within the dryers 238 and 242 may vary depending upon the speed of the stainless steel belt and mesh carrying the material through the dryers.

When the film or sheet leaves the dryer 242, the temperature of the film or sheet is preferably about 180° F. and the material is about 90% solids (or the moisture component is about 10%). The temperature of the film or sheet decreases upon exposure to the ambient air and preferably this cooling effect is allowed to progress such that the temperature of the film or sheet is typically about 75° F. or 80° F. when the material enters a cutter or a shredder 244, which facilitates cutting/shredding operations.

The shredder 244 cuts the sheet into any desired configurations and size for inclusion in, for example, a cigarette. For example, a chevron cutter may be used to cut the sheet into pieces comparable in size to that of strip tobacco and suitable for inclusion in the blend of tobacco prior to cutting into cut filler at a primary of a cigarette manufacturing facility. Alternatively, a rotary shredder may shred the film or sheet into small rectangular pieces or shreds having a length of perhaps 8 mm and a width of perhaps 2 mm for inclusion with cut filler (after cutting operations at the primary). The particular dimensions and configuration of the pieces depend upon the characteristics of the specific cutter or shredder used to cut or shred the film or sheet.

The shredded film or sheet (hereinafter "bonded menthol tobacco shreds") is then conveyed to a feeder 246 which supplies the bonded menthol tobacco shreds to a mixer 254. Another feeder 248 supplies another shredded or cut component of a cigarette blend such as an expanded tobacco, expanded stem or other component in a ratio of about 2 or 3 parts menthol-fast tobacco to one part of the other shredded blend component in a generally uniform manner. By such mixing, the tendency of the bonded menthol tobacco shreds to clump or stick together during storage is significantly reduced.

The bonded menthol tobacco shreds by itself or in the aforementioned mixed condition is then conveyed either directly to inclusion in a product such as cigarettes, or more commonly, is conveyed to containers for storage and transport to facilities for later inclusion in a product such as cigarettes.

The ratio of the blended, shredded film or sheet in the products such as cigarettes depends upon the desired characteristics of the product such as the preferred or predetermined amount of menthol.

In the embodiment of FIG. 3, a cast reconstituted tobacco product with bonded menthol using sucrose is provided. However, other saccharides, as discussed above, may be used instead of sucrose. Other polysaccharides may be preferred. In addition, other arrangements and processes for forming a film or sheet material from the mixture, such as those that employ paper making technology and techniques Variations and modifications of the foregoing will be apparent to those skilled in the art. Such variations and modifications are to be considered within the purview and scope of the claims appended hereto. For example, inclusion of the reconstituted tobacco with bonded menthol in a smoking article as taught above could be undertaken in lieu of or in combination with other previously know techniques of including menthol in such product.

What is claimed is:

1. A mentholated smoking article comprising shreds of sugar encapsulated menthol, the shreds comprising 85 to 95% by weight solids and 5 to 15% by weight water, wherein the solids comprise on a dry weight basis approximately 10 to 30% by weight menthol, approximately 45 to 55% by weight sugar, approximately 5 to 7% by weight gum binder and a remainder tobacco particles and wherein the sugar is sucrose and the gum binder is guar gum.

2. The smoking article of claim 1 further comprising a filter and a sorbent in the filter of the smoking article.

3. The smoking article of claim 1, wherein the shreds exhibit loss of retention of menthol of less than 50% after exposure to atmospheric air for 3 hours at 50° C.

4. Tobacco shreds of sugar encapsulated menthol, the shreds comprising 85 to 95% by weight solids and 5 to 15% by weight water, wherein the solids comprise on a dry weight basis approximately 10 to 30% by weight menthol, 45 to 55% by weight sugar, approximately 5 to 7% by weight gum binder and a remainder tobacco, wherein the sugar is sucrose and the gum binder is guar gum.

5. The shreds of claim 4, wherein the shreds exhibit loss of retention of menthol of less than 50% after exposure to atmospheric air for 3 hours at 50° C.

6. A cigarette comprising a blend of cut filler and a wrapper about the cut filler, the blend including the tobacco shreds of claim 4.

* * * * *